United States Patent [19]

Clay

[11] 4,290,357

[45] Sep. 22, 1981

[54] INDEPENDENTLY OPERABLE MULTIHEAD ENDLESS BAND PRINTER

[75] Inventor: Bobby J. Clay, Cincinnati, Ohio

[73] Assignee: Natmar, Inc., Cincinnati, Ohio

[21] Appl. No.: 82,981

[22] Filed: Oct. 9, 1979

[51] Int. Cl.[3] ..... B41J 1/20

[52] U.S. Cl. ..... 101/111; 101/93.14; 101/98

[58] Field of Search ..... 101/93.01, 93.08, 93.10, 101/93.11, 93.12, 93.26, 93.27, 93.14, 111, 110, 97, 98, 101, 108; 400/33, 124

[56] References Cited

U.S. PATENT DOCUMENTS

| | | | |
|---|---|---|---|
| 782,923 | 2/1905 | Robertson | 101/111 |
| 1,034,096 | 7/1912 | Fischer | 101/98 |
| 2,874,634 | 2/1959 | Hense | 101/93.26 X |
| 2,896,533 | 7/1959 | Boker et al. | 101/101 |
| 3,159,099 | 12/1964 | Wadey | 101/93.10 X |
| 3,797,629 | 3/1974 | Moser | 400/124 |
| 4,041,859 | 8/1977 | Gillstrom | 101/111 |
| 4,219,280 | 8/1980 | Maeda | 400/124 |
| 4,222,327 | 9/1980 | Hamisch | 101/111 |

OTHER PUBLICATIONS

Drejzs, IBM Tech. Discl. Bulletin, vol. 17, No. 11, Apr. 1975, p. 3246.

*Primary Examiner*—Edward M. Coven

*Attorney, Agent, or Firm*—Wood, Herron & Evans

[57] ABSTRACT

A marking machine having plural marking heads, the novel heads being separately reciprocable between a retracted storage position and an extended marking position to provide plural print lines on, e.g., a label. The marking heads reciprocate in motion planes angled relative one to another, with at least one of the motion planes being angled at an acute angle to the machine's platen, to permit closer spacing of the print lines one to the other on the label. The marking machine also includes a novel inker mechanism that permits an ink pad to be easily removed from gravity connected relation with its motor for re-inking of the pad apart from the machine. The marking machine further includes a novel print adjustor mechanism for each marking head which selectively cooperates with all print bands on wheels of that head for easy and simple manual repositioning of the bands on wheels as desired.

15 Claims, 9 Drawing Figures

INDEPENDENTLY OPERABLE MULTIHEAD ENDLESS BAND PRINTER

This invention relates to marking machines.

A marking machine, basically, is a machine adapted to mark or print one or two lines of identification indicia on, e.g., a label or a tag. The marking machine normally carries a series of print wheels or print bands aligned on a common axis in the case of a single line machine, or on two separate and spaced axes in the case of a double line machine. These print wheels or print bands are provided with an adjustment mechanism that permits the machine's user to reposition or change the characters to be printed so as to accommodate changes in the information to be marked or printed on the lable or tape. In use, the single marking head, in the case of a single line machine, or both marking head simultaneously, in the case of a double line machine, reciprocate relative to a platen on which the label or tape is positioned.

Marking machines have found numerous uses in various industries. One typical and common use of a marking machine is for printing a line of identification information on a temporary or semi-permanent label for attachment to a garment. This use is prevalent in the laundry industry and in the uniform rental industry. The objective here, of course, is to provide sufficient identification on the garment's owner and/or user so as to permit return of that garment to the owner after it has been cleaned and/or used. Another common use for marking machines is in the packaging industry. In this industry, marking machines are often used for marking labels to be used on boxes and the like. One particular use here is in parts packaging where a different code identification is required for different parts. This code information is often marked on the same base label, i.e., on a pre-printed common label with the same design and manufacturer's name and address. The marking machine is particularly adaptable to the end uses because the machine's type wheels or bands are easily changeable by the user to reflect continuous changes in the information required to be marked. Further, the marking machine is particularly adaptable to these end used because it can imprint information on heat sensitive labels, pressure sensitive labels, wet glue labels, and the like.

Marking machines of the prior art normally provide a single line of information, or a double line of information. In certain end uses, however, it has become desirable to provide more than two lines of information, e.g., three lines of information, and it is important that these three lines of information be provided with relatively minimum spacing between them in order to prevent over-sizing the, e.g., label or tag on which the information is imprinted. Therefore, it has been a first objective of this invention to provide a new and improved marking machine having plural marking heads in which at least two lines of information may be printed in close relation relative one to the other on, e.g., a label. In this connection, and in the marking machine of this invention, there is provided at least two individual marking heads that reciprocate separately one of the other relative to a platen, the reciprocation or motion planes of the heads being angled relative one to another and relative to the platen so that the motion planes of those heads, if extended beyond the platen, would intersect in a line beyond that platen.

Further, in marking machines of the prior art it is, of course, necessary to provide an inker mechanism by which the marking heads can be inked and re-inked. Normally, a marking head is re-inked after every marking cycle by a mechanism that interconnects the ink pad with the marking head so that, in one of the extend and retract portions of the marking head's cycle, the line characters in use on the marking head are inked. These prior art inker mechanisms, however, are often relatively complex mechanical structures in the first place, and it is often difficult to remove the ink pad from assembled relation with the machine for re-inking of the pad in the second place. Therefore, it has been a second objective of this invention to provide a novel and improved marking machine having a novel inker mechanism. The preferred inker mechanism of this invention includes a lever operated gravity connect/disconnect structure which allows the mechanism's fluid motor to be easily disconnected from and reconnected to the ink pad itself, thereby permitting the ink pad to be slid out and removed from the machines's frame for easy re-inking.

Still another problem with marking machines of the prior art has been adjustment of each of the print bands or print wheels which comprise a marking head, and which cooperate to provide the line of information to be marked or imprinted. There is known to the prior art various adjustor mechanisms by which the print bands or print wheels can be manually adjusted without touching those bands or wheels (which, of course, are inked during use). However, often these mechanisms are relatively complex of structure and, therefore, expensive to fabricate. Further, often these mechanisms provide use or maintenance problems to the machine's user. Therefore, it has been a third objective of this invention to provide a novel and improved print adjustor mechanism for a marking machine. In accord with this objective, the adjustor mechanism of this invention includes a friction wheel slidable along a drive shaft from one end of the marking head to the other, the friction wheel being pivotable into and out of pressed frictional engagement with the exterior periphery of the print band or wheel selected, re-positioning of that type band or wheel as desired being achieved by simultaneous rotation of the drive shaft.

Other objectives and advantages of this invention will be more apparent from the following detailed description taken in conjunction with the drawings in which.

Figure 1:
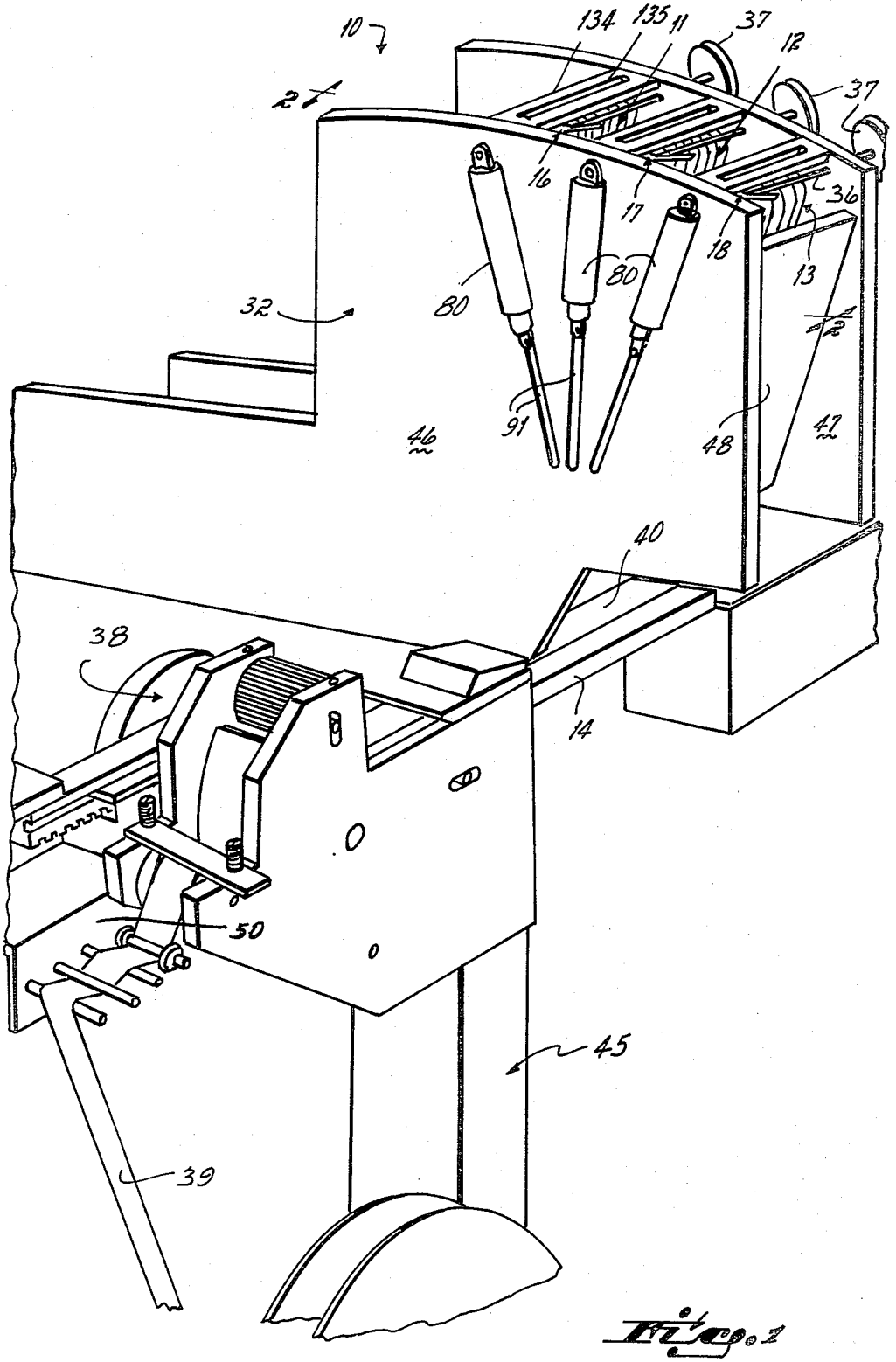
FIG. 1 is a perspective view illustrating the multiline marking machine in accord with the principles of this invention.
Figures 2, 3:
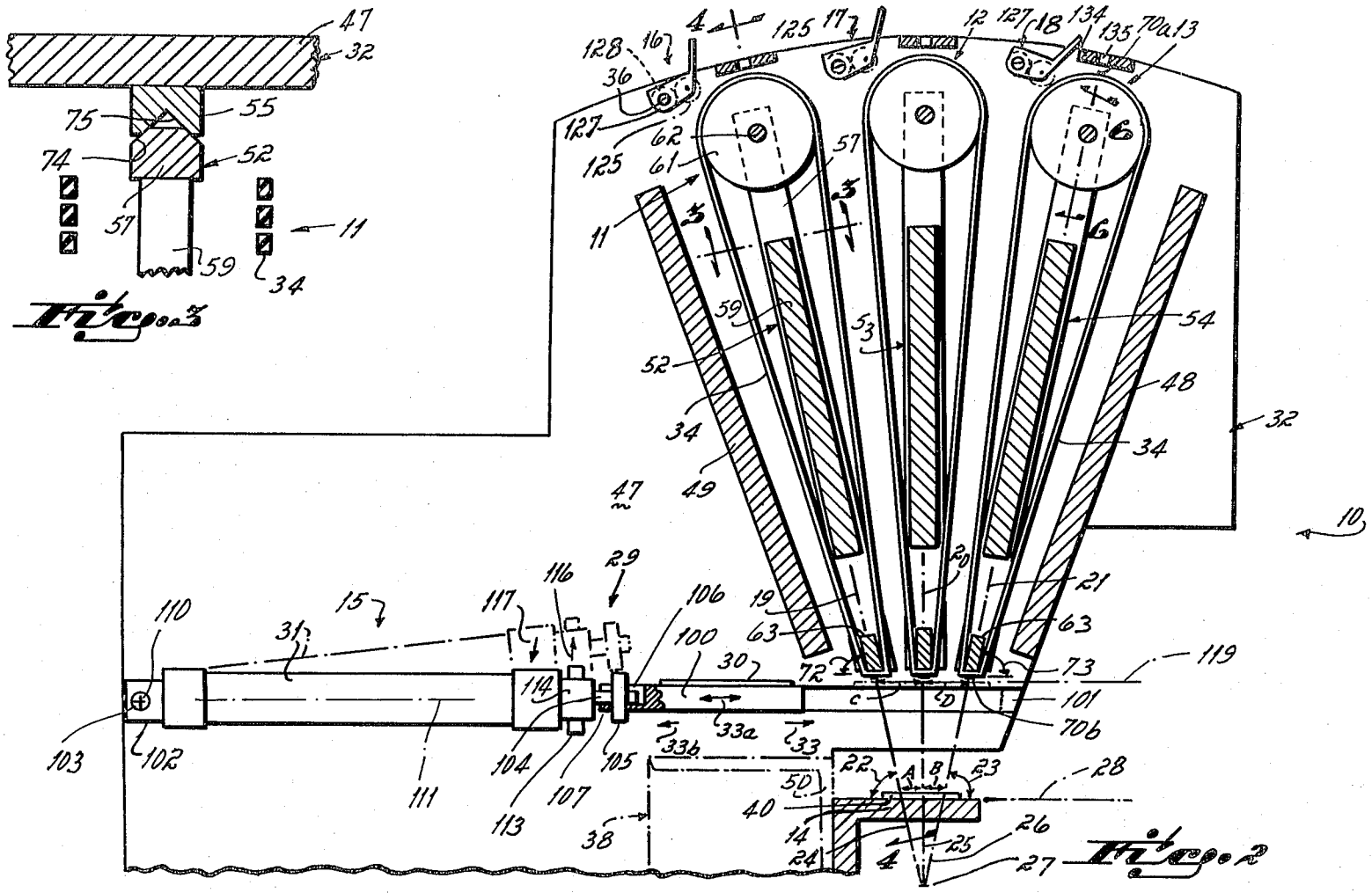
FIG. 2 is a cross-sectional view taken along line 2—2 of FIG. 1.
FIG. 3 is a cross-sectional view taken along line 3—3 of FIG. 2.

The marking machine 10 of this invention, as illustrated in FIGS. 1 and 2, is basically comprised of three separately movable marking heads 11–13, which cooperate with a platen 14, an inker mechanism 15, and three separate print adjustor mechanisms 16–18 with each one of the print adjustor mechanisms being adapted to cooperate with one of the marking heads. The three marking heads 11–13 are reciprocable in three separate motion planes 19–21 that are all angled relative one to another when viewed in end edge view as shown in FIG. 2. Further, the outside two of these motion planes 19, 21 are angled or positioned at acute angles 22, 23 relative to the machine's platen 14, these angles facing or opening away from one another and thereby being different one from another, and the center motion plane 20 is positioned perpendicular or normal to the machine's platen 14, thereby forming an angle also different from angles 22, 23 when the planes 19–21 are viewed in end edge view as shown in FIG. 2. Note also that the motion planes 19–21 of the heads 11–13, if extended beyond the platen 14 in phantom line 24–26 fashion, respectively, intersect in a common phantom line 27 beyond the platen, the line 27 being parallel to but spaced from the horizontal imprint plane 28 defined by the platen. In this regard, too, the motion planes 19, 21 of outside marking heads 11, 13 form acute angles 22, 23 with the imprint plane 28, and the motion plane 20 of center marking head 20 is normal to that imprint plane 28. The inker mechanism 15 is provided with a gravity connector structure 29 that permits the ink pad 30 to be easily disconnected from and reconnected to its motor 31 (compare solid line connect position to phantom line disconnect position shown in FIG. 2), see FIGS. 2 and 8. This permits the ink pad 30 to be slidably removed from the machine's main frame 32 by sliding it outwardly in the direction shown by direction arrow 33 for re-inking purposes. Each of the print adjustors 16–18 is movable between a storage position (shown by adjustors 16 and 17), and a use or print position (shown by adjustor 18), relative to the respective marking head 11–13 with which it is related, see FIGS. 2 and 7. In the use position, the print adjustor 18 is manually depressed against flexible print band 34 through use of thumb lever 35 by one of the user's hands while drive shaft 36 is rotated by the other of the user's hands through use of knob 37. The marking machine 10 of this invention is particularly adapted to be used with a tape feed and cutter mechanism 38. The tape feed and cutter mechanism 38 functions to feed a continuous tape strip 39 in predetermined label lengths 40 from a supply reel (not shown) into marking position on the machine's platen 14. Once the appropriate three lines of information have been marked on the label length 40 positioned on the platen 14, the label 40 is cut from the continuous tape strip 39 and removed from the platen 14. The tape feed and cutter mechanism 38 by itself forms no part of the marking machine 10 of this invention. The tape feed and cutter mechanism 38 is particularly disclosed in now pending U.S. patent application Ser. No. 920,178, filed June 29, 1978, invented by the same inventor of this application. The full disclosure of the tape feed and cutter mechanism 38 in that application is hereby incorporated in this application by reference.

The marking machine 10 of this invention, as mentioned above, includes three separate marking heads 11–13. These marking heads are carried in a main frame 32 mounted on a stand 45. The main frame 32 includes stationary side frame plates 46, 47 held in rigid spaced relation one from the other by front 48 and rear 49 cross plates, see FIG. 1. The platen 14 is fixed to an angle member 50 of the tape feed and cutter mechanism 38 and has a flat platen surface or plane 28 oriented horizontal to ground, see FIG. 2. The cross plates 48, 49 are bolted to the side plates 46, 47 by suitable fasteners, not shown.

Each of the separate marking heads 11–13 is mounted in its own head frame 52–54, respectively, and all three head frames are carried for reciprocal movement in the main frame 32. The three head frames 52–54 are carried in the main frame 32 by outer guide posts 55, 56 so that, when viewed from the side as shown in FIG. 2, and when the three heads 11–13 are retracted in storage position, the three heads are angled relative one to another in the fashion previously described. As to each marking head 11–13, the three heads are substantially identical one to the other with one significant difference discussed in further detail below.

Figure 5:
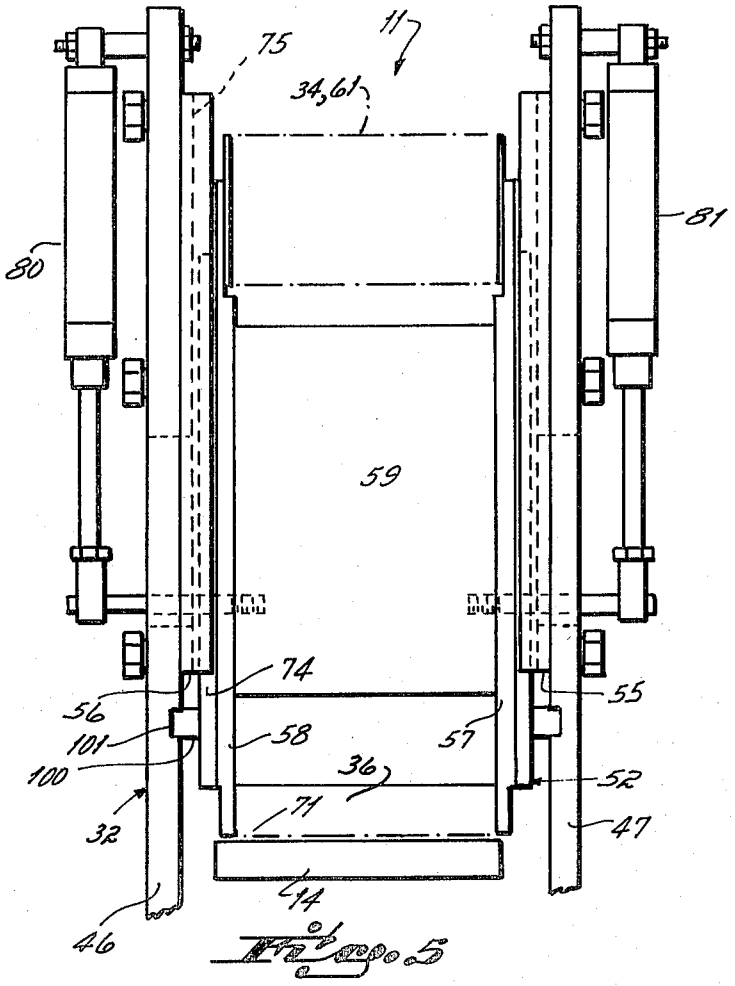
FIG. 5 is a view similar to FIG. 4 but illustrating a marking head in the fully extended or marking position.
Figure 6:
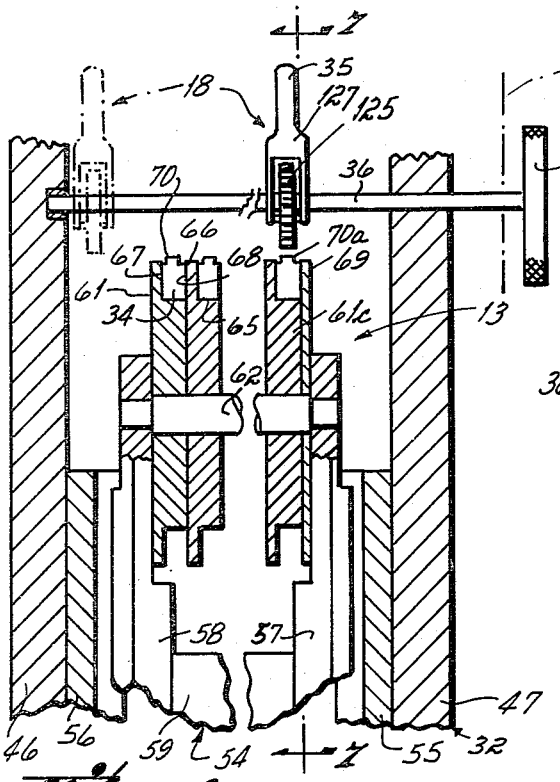
FIG. 6 is a cross-sectional view of FIG. 4.

Each of the marking heads 11–13 includes a generally H-shaped head frame 52–54, head frame 52 being shown in FIG. 5. Head frame 52, for example, includes inner guide posts 57, 58 bolted to a center force plate 59 by bolts 60 on each side thereof. The head frame's inner guide posts 57, 58 are received in sliding relation with the main frame's outer guide posts 55, 56. The top end of the sub-frame carries a series of wheels 61 on an axle 62 received in bores of the inner guide posts 57, 58, that axle being aligned parallel to the horizontal platen 14 and in the motion plane 19 of that head 52. The wheels 61 are rotatable relative one to the other on the axle 62. A backup bar 63 is connected by screws 64 to the bottom ends of the inner guide posts 57, 58. Each of the three marking heads 11–13 further includes a series of print bands 34, each of which is trained around the backup bar 63 at one end, and an individual wheel 61 at the other end, in closed loop fashion. The print bands 34 carry a series of characters 70, e.g., numbers, letters or symbols, on the exterior face thereof. Each of the wheels 61 includes a hub 65 over which the print band 34 is trained, and a flange 66 at one edge thereof to retain each band 34 at one edge face 67 thereof, the flange 66 of one wheel 61 cooperating with the flange 66 of an adjacent wheel 61, hence, with the other edge face 68 of the band 34, to hold the print band in proper aligned location on the hub 65 as shown in FIG. 6. The end wheel **61*c* includes a spacer flange 69 which serves the same location function as an adjacent wheel, see FIG. 6**.

Note particularly the bottom surface 61 of the backup bar 63 for each marking head 11–13. This surface 71, in each case, is formed parallel to the platen's surface 28, and it is this bottom or force face of the backup bar for each head 11–13 which constitutes the one difference between the three separate head frames 52–54. The force face 71 of each backup bar for each outside head 11 and 13 is angled at an acute angle 72, 73, respectively, relative to the reciprocation or motion planes 19, 21 of those outside heads, and is perpendicular to the motion plane 20 of the center head 12 when the heads 11–13 are viewed as in FIG. 4. But in all three marking heads 11–13, since the force faces 71 are positioned parallel to the platen's surface 28, it is insured that the to-be-printed characters **70*a* on each of the heads will properly be marked or imprinted on the label 40** on the platen.

Figure 4:
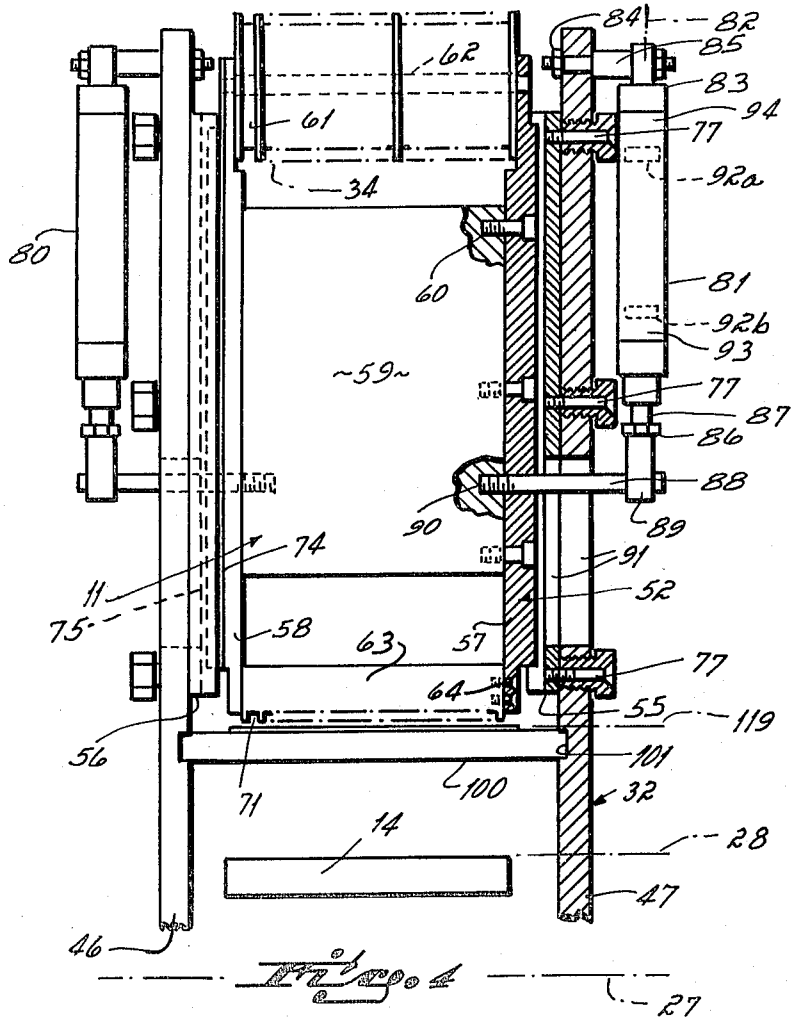
FIG. 4 is a cross-sectional view taken along line 4—4 of FIG. 2, and showing a marking head in the fully retracted or storage position.

Each of the marking heads 11–13, which head 11 or 12 or 13 is comprised of a series of closed loop print bands 34, a series of wheels 61 on a rotation axis 62, a backup bar 63 with a force face 71 parallel to platen plane 28, and a head frame 52 or 53 or 54, is mounted for reciprocatory motion in the machine's main frame 32 by structure particularly shown in FIGS. 3 and 4. The inner guide posts 57, 58 of each head frame 52–54 are beveled on their outer edges, as at 74 and as shown in FIG. 3, to cooperate with V-shaped grooves 75 in outer guide posts 55, 56 fixed to the main frame's side plates 46, 47. The outer guide posts 55, 56 are fixed to the main frame's side plates 46, 47, as shown in FIG. 4, by mounting screws 77, and inner guide posts 57, 58 are fixed to force plate 59 and backup bar 63 by mounting screws 60, 64, respectively. Thus, the faces 74 of the inner guide posts 57, 58 cooperate with the V-shaped grooves 75 in the outer guide posts 55, 56 to define the reciprocation or motion planes 19–21 of the respective marking heads 11–13.

Each marking head 11–13 is powered in its reciprocation cycle between its retracted or storage position shown in FIG. 2, and its fully extended or marking position shown in FIG. 5, by a pair of fluid motors 80, 81 mounted on each side of the main frame 32. Each fluid motor 80, 81 is in the nature of a pneumatic cylinder, the axis 82 of which is in the reciprocation plane 19 or 20 or 21 of the respective marking head frame 52 or 53 or 54 with which it is connected. The top end 83 of each pneumatic motor 80, 81 is bolted to the main frame's side plates 46 and 47 as shown at 84, and is spaced therefrom by spacing collar 85. The free end 86 of each pneumatic motor's rod 87 is mounted to connector bolt 88 by a coupling 89. The connector 88 is fixed to the marking head's head frame 52 or 53 or 54 as at 90, and extends through slot 91 in the main frame's side plate 46 or 47. This slot 91 in the side plate is, likewise, positioned within the motion plane 19 or 20 or 21 of the marking head 11 or 12 or 13 with which it is associated. Hence, and upon retraction of the motor's pistons 92 to an upper position as shown at **92*a* by introduction of high pressure air into retract chambers 93 of the motors 80, 81, each head frame 52–54 is retracted to the position shown in FIGS. 2 and 4. Upon exposure of the motor's extend chambers 94 to high pressure, the pistons 92 are extended to a lower position as shown by 92*b* at which pivot bands 34, as backed by the backup bar 63, contact either an interposed ink pad 30 for re-inking, or a label 40 on the platen 14 to be imprinted as shown in FIG. 5. The dual motors 80, 81 on opposed sides of each head frame 52 are useful in preventing cocking or other binding of each head frame's inner guide 57, 58 within the main frame's outer guides 55, 56**.

Figure 8:
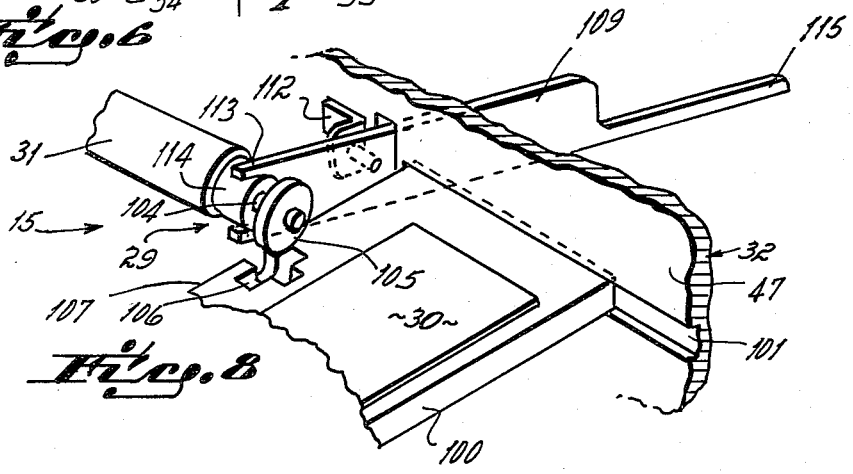
FIG. 8 is a perspective view illustrating the ink pad motor mechanism.

The inker mechanism 15 by which the marking heads 11–13 are repeatedly inked and re-inked is illustrated in FIGS. 2, 4, and 8. As shown particularly in FIGS. 2 and 8, the inker mechanism 15 includes an ink pad 30 received in an ink pad frame 100, the ink pad frame being slidable on tracks 101 mounted to opposite side plates 46, 47 of the machine's main frame 32. These tracks 101 are horizontally disposed relative to ground and, therefore, parallel to the marking plane 28 of the machine's platen 14. Note particularly the tracks 101 are mounted so that the ink pad 30 is reciprocable, as shown by direction arrow **33*a*, between a retracted position shown in solid lines in FIG. 2 where it does not and cannot interact with reciprocation of the marking heads 11–13, and an extended position shown in phantom lines in FIG. 2 where it interacts the reciprocation on motion planes 19–21 of those marking heads prior to those heads contacting platen 14. This, of course, is because the ink pad's reciprocation path 33*a* is positioned between the retracted position of the marking heads 11–13 and the platen 14** itself.

The ink pad motor 31, which extends and retracts the ink pad 30 itself, is in the form of a fluid motor pivotally connected at its rear end as at 102 to a cross bar 103 mounted between the machine's side plates 46, 47. The reciprocable piston rod 104 of the fluid motor 31 (which is preferably a pneumatic cylinder) is connected at its other end to the ink pad frame by the gravity connector 29. The gravity connector 29 structure includes a collar 105 fixed to the free end of piston rod 104, the collar being receivable in seat 106 defined in rear edge 107 of the ink pad frame 100, see FIG. 8. A lever arm 109, which extends parallel to the motor's pivot axis 110 and, therefore, perpendicular to the cylinder rod reciprocation axis 111, is pivotally connected to the machine's frame 32 intermediate its ends by a bracket 112 mounted to the machine frame's side plate 47. The lever arm 109 includes a forked end 113 that embraces motor housing 114 at that end of motor 31 opposite its pivotal connection (at 102) with the machine's main frame 32. The other or free end 115 of the lever arm 109 extends outwardly of the machine's main frame 32 where it can be manually depressed when desired by an operator. When the lever arm's free or unconnected end 115 is depressed by a user, the pneumatic motor 31 is pivoted upwardly (as shown by phantom arrow 116) out of its gravity connection with the ink pad frame 100, i.e., the gravity connector 29 is disconnected, compare solid line position of the motor in FIG. 2 to the phantom line position of the motor in FIG. 2. This permits the machine's user to reach beneath the marking heads 11–13 and manually withdraw the ink pad frame 100 forwardly in a direction shown by phantom arrow 33 out from operable connection with the marking machine 10 itself. Such permits the ink pad 30 to be re-inked easily apart from the machine by the machine's user. Of course, when reconnection with the ink pad 30 and the motor 31 is desired, the motor is simply pivoted upwardly by use of the manual lever arm 109, the ink pad frame 100 reinserted into its tracks 101 and slid rearwardly as shown by direction arrow **33*b* toward the motor until the motor's collar 105 is oriented above the ink pad frame's seat 106. The lever arm 109 is thereafter released so that the gravity connection between motor 31 and ink pad 30 can be re-established as the motor 31 pivots downwardly in direction of phantom arrow 117 until the collar 105 is reseated in the ink frame's seat 106**.

In use of the marking heads 11–13 of this invention, it is apparent that all three heads cannot be reciprocated simultaneously within their reciprocation or motion planes 19–21 marking three lines of characters simultaneously on a label 40 or other substrate on the platen 14. This, of course, for the reason that the structures of the three heads 11–13, at the bottom or backup bar ends 63 of each, would run into each other and become jammed in light of spacing A, B between the heads' motion planes 19–21 in the platen plane 28. Consequently, and in accord with the principles of this invention, it is preferred that the center marking head 12 reciprocate vertically along in reciprocation plane 20 to imprint its single line of information on the label 40, and the two outside marking heads 11, 13 reciprocate separately and simultaneously in reciprocation planes 19, 21 to imprint their two lines of information on the label 40. This reciprocation cycle sequence of the plural marking heads 11–13 permits minimum spacing A, B between information lines on the finished label 40. The marking heads 11–13 are caused to move in this controlled sequence by an air logic circuit which controls the pneumatic motor pairs 80, 81 for each of the heads. This air logic circuit is described in greater detail below.

While the three marking heads 11–13 move in a predetermined one then two sequence in the marking portion of a marking and re-inking cycle, the three heads move simultaneously into re-inking relation with the ink pad 30 during the inking portion of a marking and re-inking cycle. Simultaneous movement of the three marking heads 11–13 into re-inking relation with the ink pad 30 extended into the phantom line position by inker motor 31, as shown in FIG. 2, is possible in the structural environment shown because the spacing C, D between the reciprocation planes 19–21 at the re-inking plane 119 is substantially greater than the spacing A, B, between the reciprocation planes 19–21 at the marking plane 28. The marking heads 11–13 are caused to move in this re-inking portion of the controlled sequence also by the air logic circuit which controls the pneumatic motors 80, 81 that reciprocates the heads, as well as which controls the pneumatic motor 31 that reciprocates the ink pad 30 into and out of the marking heads' motion planes 19–21, as described in greater detail below. Reciprocation of the marking heads 11–13, of course, requires reciprocation of each of the marking head frames 52–54, as guided by the outer guides 55, 56 mounted to the main frame's side plates 46, 47 and by the inner guides 57, 58 mounted to the head frames' force plates 59, all as shown in FIGS. 2–4.

Figure 7:
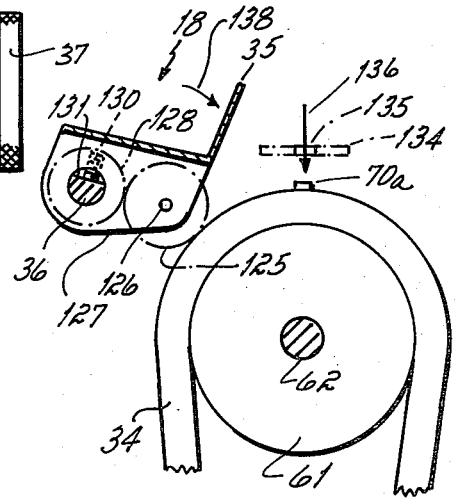
FIG. 7 is a cross-sectional view taken along line 7—7 of FIG. 6.

A separate print adjustor mechanism 16–18 is provided to cooperate with each of the marking heads 11–13, respectively, all three of the print adjustors being of identical structure and functioning in identical fashion. The print adjustor mechanisms 16–18 are shown in FIGS. 2, 6 and 7. Each print adjustor is comprised of a friction wheel 125 movable between a storage location out of contact with all the bands 34 of a marking head (see phantom line position of FIG. 6), and a reset position where the friction wheel is positioned against the outer surface of the band to be adjusted (see solid line position of FIGS. 6 and 7). The friction wheel 125 is in the nature of a gear mounted on rotation axis 126 to U-shaped bracket 127. The bracket 127, which includes handle 35, also carries a drive gear 128 with which the friction gear 125 is in meshed relation, the drive gear being mounted on drive shaft 36. The drive gear 128 is prevented from rotation with the drive shaft 36 by set screw 130 that cooperates with a flat 131 that extends the length of the shaft 36. The set screw 130 is tightened sufficient to prevent rotation of the drive gear 128 relative to the drive shaft 36, but not sufficient to prevent the drive gear and, hence, the friction wheel 125, all as carried by bracket 127, to slide axially of the drive shaft from the storage position adjacent one of the machine frame's side plates 46 to a related reset position above a type band. The drive shaft 36 is connected between the main frame's side plates 46, 47 in rotational relation as shown in FIG. 6, and is positioned parallel to the axis 62 of the head's wheels 61. The free end of the drive shaft 36 is provided with knurled knob 37 located outside the machine's housing (shown by phantom lines 123 in FIG. 6 but not shown in detail) so that it is readily available for use. A sight slot frame 134 is positioned above the marking head parallel to the axis 62 of the wheels 61. The sight slot frame 134 is also mounted between the main frame's side plates 46, 47, and the slot 135 in that frame, which slot extends from one end wheel 61 to the other end wheel of the marking head, is wide enough to permit sighting of a single character 70 on the print band when viewed in the direction of sight arrow 136.

In use of a print adjustor mechanism, and when it is necessary to reset a band 34 on a marking head, the adjustor mechanism is slid along the drive shaft 36 from the storage position shown in phantom lines in FIG. 6 to that band which must be adjusted as shown in solid lines in FIG. 6. Thereafter the bracket and, hence, the adjustor, is swung or pivoted about drive shaft 36 from an outer or storage position that allows the adjustor to be moved along the shaft 36 without contacting the head's wheels 61, to a use position where the friction gear 115 contacts the outer surface of the band as shown in FIG. 7. Subsequently, the user depresses the bracket handle 35 with one hand in the direction shown by direction arrow 138 so as to force the friction wheel 115 into frictional relation with band 34 and, thereby, force the band against the wheel's hub 65 over which it is looped. Simultaneously, the user rotates the knob 37 with his other hand. These manual operations cause the print band 34 to move in closed loop fashion between the marking head's backup bar 63 and wheel 61 until the desired character 70*a* on the band is sighted through the sight slot 135. There are two sets of the same characters on the band 34 so that when the character 70*b* desired in the marking position as supported by backup bar 63 is in proper location under that backup bar, an identical character 70*a* is sighted through the sight slot 135.

Figure 9:
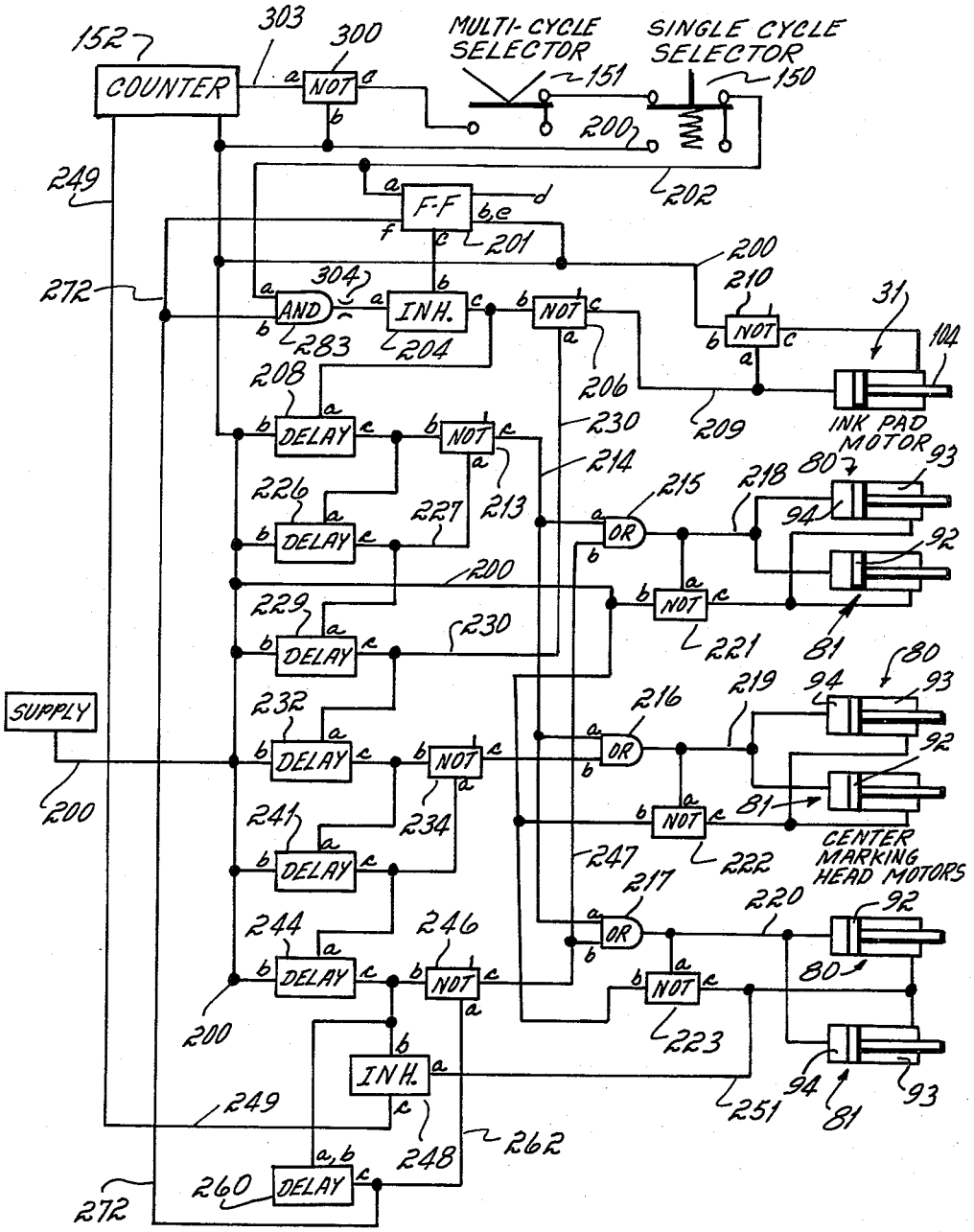
FIG. 9 illustrates an air logic circuit for operating the marking machine.

A pneumatic logic circuit for operating the marking machine of this invention is shown in FIG. 9, and as shown there comprises a single cycle selector 150, a multi-cycle selector 151, and a counter 152. These selectors 150, 151 are in the form of open/close valves. One input of the single cycle selector 150 is connected directly to a supply line 200, and the other input of the single cycle selector is serially connected through the multicycle selector 151 and the counter 152 to the pneumatic control circuit. The circuit includes a FLIP-FLOP, an AND, and plural NOTs, INHIBITORs, ORs, and DELAYs. In a FLIP-FLOP, ports a and f function as pilot ports to control the state of the FLIP-FLOP, ports b and c are pressure ports connected to supply line 200, port c is an operation port and is connected to the circuit, and port d is an exhaust port. In an AND, both pressure ports a and b have to be pressurized to pass pressurized flow through the AND. In an OR, only one of both pressure ports a, b have to be pressurized to pass pressurized flow through the OR. In a NOT, ports b and c are always connected when there is no system, i.e., high pressure at port a, but ports b and c are disconnected when there is system, i.e., high pressure at port a. In an INHIBITOR, ports b and c are always connected when there is no pressure at port a, but ports b and c are disconnected when there is very low pressure, i.e., substantially less than system pressure, at port a, but ports b and c are not disconnected when there is high or system pressure at port a.

The circuit as shown in FIG. 9 will first be described in combination with a single cycle operating sequence. In a single cycle operation, the single cycle selector 150 is depressed to momentarily connect the supply line 200 directly to the pilot port a of a FLIP-FLOP 201 via line 202. This causes pressure port b, e to be connected to the c port which is connected to the b port of an INHIBITOR 204. The c port of this INHIBITOR is connected to the b port of NOT 206 and to a DELAY 208. Since a NOT is functional to allow air pressure to pass from port b to port c as long as port a is inactive, at this stage the air pressure will pass through NOT 206 and connect with line 209 since there is no pressure flow on port a of NOT 206. Line 209, in turn, is connected to the ink pad motor 31 so as to extend the ink pad 30 between the marking head and the platen 14. Line 209 is also connected to port a of NOT 210 which, because it is pressurized from line 209, will disable NOT 210 to disconnect the supply line 200 from the motor 31 and exhaust the cylinder to atmosphere through NOT 210. With NOT 210 disabled the ink pad motor 31 is now free to extend.

The activation of DELAY 208 will, after a predetermined delay, send pressure flow from line 200 into and through the b, c ports of NOT 213 and into line 214 which will pass through ORs 215, 216 and 217. The pressure flow passing through OR 215, 216, 217 is fed into the three marking head motor pairs 80, 81 via lines 218, 219 and 220. Air pressure on line 218 also will pass to the port a of NOT 221 and disable that NOT, air pressure on line 219 will pass to the port a of NOT 222 to disable that NOT, and the air pressure in line 220 will pass to the port a of NOT 223 to disable that NOT. With the NOTs 221, 222 and 223 disabled, air pressure is removed from the lower ends 93 of the motors 80, 81 so that they are free to move in a simultaneous downward response to pressure at their top ends 94, thereby extending the marking heads 11, 12, 13 into re-inking relation with the ink pad 30. These motors 80, 81 exhaust through respective NOTs 221–223 to atmosphere.

The timing out of DELAY 208 also sent pressure to a DELAY 226. The DELAY 226 is connected via line 227 to the port a of NOT 213 and, after a predetermined delay, will disable NOT 213 to remove air pressure from line 214. The removal of pressure in line 214 switches the NOTs 221, 222 and 223 back to their normal state, removes pressure from the top sides 94 of the motors 80, 81, and pressurizes the cylinders' lower end to cause them to move upward simultaneously. In addition to disabling NOT 213, the DELAY 226 after it is timed out also activates the DELAY 226 which, after a predetermined delay, will pressurize port a of NOT 206 via line 230. This disables NOT 206 which, in sequence, re-enables NOT 210 so that the ink pad 30 is retracted. DELAY 229 also is connected to a DELAY 232, which after a delay, will pressurize the ports b, c of NOT 234 and the line connected to OR 216 which will activate the center motor pair 80, 81 of the center marking head 12 via line 219 and lower them. The line 219, as previously described, is also connected to port a of NOT 222 which disables NOT 222 to remove pressure flow from the bottom sides of the motors 80, 81 as pressure flow is introduced into the top sides of the motors 80, 81. The exhaust flow from the bottom sides of the motors 80, 81 passes to atmosphere through the NOT 222.

The DELAY 232 is also connected to a DELAY 241 which after a delay is effective to disable NOT 234. Disabling of NOT 234 will remove pressure from the OR 216 and raise the center motors 80, 81 to their normal upraised position because NOT 222 is re-enabled, thereby re-connecting the lower end of the center motors to supply line 200. In addition to disabling NOT 234 the timing out of DELAY 241 also activates the DELAY 244 which will, after a predetermined delay, pressurize the ports b, c of NOT 246 and line 247. Pressure flow in line 247 is sent to ORs 215 and 217 to pressurize the top ends 94 of motor pairs 80 and 81 for the front and rear or outside marking heads 11, 12 via lines 218 and 220. Pressure flow in these lines 219, 220 will disable NOTs 221 and 223 to remove pressure flow from the lower ends of the motor pairs 80, 81 while pressure flow is simultaneously introduced into the top ends of these motor pairs. The exhaust from the motor pairs' lower ends is passed to atmosphere through NOTs 221 and 223.

The timing out of DELAY 244 also introduces pressure flow into the port b of INHIBITOR 248. INHIBITOR 248 is connected via its ports b, c and line 249 to the counter 152, thereby activating a single count on the counter. The port a of INHIBITOR 248 is connected via line 251 to the bottom sides 93 of the one outside pair 80, 81 of these marking head motor pairs. As this motor pair 80, 81 nears the end of its downward or exterior stroke the exhaust flow pressure is decreased, for example, to 3 psi. It is this reduced flow pressure on port a of INHIBITOR 248 that is effective to disconnect ports b and c of INHIBITOR 248, and to return the INHIBITOR 248 to its normal condition after activating a single count on the counter via line 249. The activation of the counter 152 is not necessary for operation in the one cycle mode, but is activated in this manner when in the multi-cycle mode, to be described below.

The timing out of DELAY 244 is also effective to initiate a DELAY 260 which, after the predetermined time lapse, will pressurize line 262 which results in disabling of NOT 246. Disabling of NOT 246 is effective to remove pressure flow from the line 246, which fed ORs 215 and 217. With these ORs 215, 217 having their pressure removed, the outside motor pairs 80 and 81 will return to their normal state by removal of air pressure from lines 218 and 220, and pressure is applied to their return chambers 93 through the now re-enabled NOTs 221 and 223. This pressure flow release from lines 218, 220 is exhausted to atmosphere through NOTs 221, 223. The timing out of DELAY 260 also sends pressure to a line 272 which, in turn, is connected to the port f of FLIP-FLOP 201, and to one port b of AND 283. Because the depression of single cycle selector 150 causes only momentary pressure at port a of FLIP-FLOP 201, a signal reaching the pilot port f of FLIP-FLOP 201 connects the pressure ports b, c of this FLIP-FLOP with exhaust port d and, thereby, to atmosphere. In the multi-cycle mode to be described, pressure would remain at port a of FLIP-FLOP 201 and this pressure would override the pressure at port f. Therefore, because pressure exists at port f and no pressure at port a, the pressure ports b, e are connected to exhaust port d and the single cycle is ended.

In the multi-cycle mode of operation the counter 152 is set at a pre-selected number, i.e., at the number of cycles desired. The multi-cycle selector 151 is shifted from the position shown in FIG. 9 into a position to connect the counter 152 with the control circuit; in this operational configuration, the single cycle selector 150 is maintained in the position shown in FIG. 9 by its spring. When this condition exists, the marking machine 10 will continue to mark labels 40 until the counter 152 counts backwards to 0, the counter being activated by the timing out of DELAY 244 as noted above. During each marking cycle, the pneumatic circuit is completed from supply line 200 via b-c ports of NOT 300, multi-cycle selector 151, and single cycle selector 150 to the line 202. So long as the counter 152 is counting backwards and has not reached 0, no pressure signal is present on line 303 to port a of NOT 300. Therefore, a constant pressure signal is present at pilot port a of FLIP-FLOP 201 which will always override the pressure signal at pilot port f to maintain FLIP-FLIP ports b, e connected to port c. Thus, the pneumatic circuit is always completed until counter 152 reaches 0.

The AND 283 must be pressurized at both inputs a, b, i.e., pressure flow must exist in both lines 272 and 202 to pass pressure flow through that AND. The pressure in line 272 is the pressure that disabled FLIP-FLOP 201 at port f in the one cycle mode and the pressure in line 202 is the pressure at port a of that FLIP-FLOP which overrides the pressure at port f. The dual receipt of these pressure flows to and through AND 283, and through a restrictor 304 to the port a of INHIBITOR 204 will block the pressure connection b, c of INHIBITOR 204. With the INHIBITOR 204 pressure ports b, c blocked, there is an interruption to the pressure flow through the pneumatic circuits so that after a few milli-second pause the DELAY 260 is de-activated. The de-activation of DELAY 260 will remove pressure from line 272 which fed the AND 283. With no pressure at one port b of AND 283, no pressure flow will pass; thus INHIBITOR 204 will be re-enabled so that its ports b, c are connected once again to permit recycling.

It is this milli-second pause that will create pulses which are sent intermittently to the counter 152 so that the counter 152 will count down to zero. Upon reaching zero the counter 152 will permit pressure to pass through line 303 to de-activate NOT 300 so that no pressure will be supplied at the pilot port a of FLIP-FLOP 201. Thus, when the counter reaches zero, pressure at port f only of this FLIP-FLOP 201 will cause the cycling to stop.

Having described in detail the preferred embodiment of my invention, what I desire to claim and protect by Letters Patent is:

1. A marking machine comprising a platen defining an imprint plane, an inking pad defining a re-inking plane, said imprint plane and said re-inking plane being spaced one from the other, at least two marking heads, each of said marking heads comprising a series of print bands adjustable to establish a desired line of information comprised of plural letters and/or numbers, a motor for reciprocating each of said heads relative to said platen and said inking pad between a marking position, a re-inking position, and a storage position, one of said marking heads being movable in a reciprocation plane that defines a first angle relative to said imprint plane, and another of said marking heads being movable in a reciprocation plane that defines a second angle relative to said imprint plane, said first and second angles being different one from the other, a guide for directing each of said marking heads in its reciprocation path, said guides being structured to prevent all of said marking heads' print bands from all simultaneously contacting said platen, but said guides also being structured to permit all of said marking heads' print bands to all simultaneously contact said inking pad, and a control system connected with said motor, said control system being structured to cause one of said marking heads to move separately and independently relative to another of said heads as said heads are extended toward and retracted from said marking position, said guides and said control system cooperating to allow said marking heads to mark said information lines on a substrate positioned on said platen so that said information lines are closer together than would be possible if said marking heads were reciprocated in parallel paths.

2. A marking machine as set forth in claim 1, said machine further comprising a motor for reciprocating said ink pad, said motor being operable to extend periodically said ink pad to a re-inking location positioned between said marking position and said storage position of said marking heads, and said motor being operable to retract said ink pad from that re-inking location when re-inking has been achieved.

3. A marking machine as set forth in claim 2, said control system being connected with said marking head motor and with said ink pad motor, and said control system further being structured to reciprocate said marking heads into re-inking relation with said ink pad.

4. A marking machine as set forth in claim 3, said machine comprising a center marking head and two outside marking heads positioned on opposite sides of said center head, said control system being structured to cause the center head to reciprocate separately from the two outside heads, and said control system further being structured to cause said two outside heads to reciprocate substantially simultaneously one with the other.

5. A marking machine as set forth in claim 4, said control system being structured to cause all three marking heads to reciprocate simultaneously to and from said re-inking position.

6. A marking machine as set forth in claim 5, said re-inking plane being generally parallel to said imprint plane, and said re-inking position being located between said marking position and said storage position in the reciprocation path of said marking heads.

7. A marking machine as set forth in claim 6, said marking head and ink pad motors being fluid powered, and said control system being fluid operable.

8. A marking machine comprising a platen defining an imprint plane, an ink pad defining a re-inking plane, at least two marking heads, each of said marking heads comprising a series of print bands adjustable to establish a desired line of information comprised of plural letters and numbers, a motor for reciprocating each of said heads between a marking position, a re-inking position, and a storage position, one of said marking heads being movable in a reciprocation plane that defines a first angle relative to said imprint plane, and another of said marking heads being movable in a reciprocation plane that defines a second angle relative to said imprint plane, said first and second angles being different one from the other, and a guide for guiding each of said marking heads between said position, said guides being structured to space said marking heads one from the other at said marking position so that all of said marking heads' print bands cannot all simultaneously contact said platen, said guides also being structured to space said heads one from the other at said re-inking position so that all of said marking heads' print bands can all simultaneously contact said ink pad, said guide structure thereby permitting said information lines to be marked on a substrate positioned on said platen so that said information lines are closer together than would be possible if said marking heads were reciprocated in parallel planes, and said guide structure also thereby permitting simultaneous re-inking of all said marking heads.

9. A marking machine as set forth in claim 8, said machine further comprising a control system connected with said marking head motor, said control system being structured to cause one of said marking heads to move separately and independently relative to another of said heads as said heads are extended toward and retracted from said marking position, said guides and said control system cooperating to allow said marking heads to mark said information lines on a substrate positioned on said platen so that said information lines are closer together than would be possible if said marking heads were reciprocated in parallel paths.

10. A marking machine as set forth in claim 9, said machine further comprising a motor for reciprocating said ink pad, said motor being operable to extend periodically said ink pad to a re-inking location positioned between said marking position and said storage position of said marking heads, and said motor being operable to retract said ink pad from that re-inking location when re-inking has been achieved.

11. A marking machine as set forth in claim 8, said machine further comprising a motor for reciprocating said ink pad into and out of the reciprocation planes of said marking heads, and a control system connected with said marking head motor and with said ink pad motor, said control system being structured to extend and retract one of said marking heads separately and independently from another of said marking heads for marking a substrate positioned on said platen, and said control system further being structured to reciprocate said marking heads either together or separately one of the other into re-inking relation with said ink pad.

12. A marking machine as set forth in claim 11, said machine comprising a center marking head and two outside marking heads positioned on opposite sides of said center head, said control system being structured to cause the center head to reciprocate separately from the two outside heads, and said control system further being structured to cause said two outside heads to reciprocate substantially simultaneously one with the other.

13. A marking machine as set forth in claim 12, said control system being structured to cause all three marking heads to reciprocate simultaneously to and from said re-inking position.

14. A marking machine as set forth in claim 11, said re-inking plane being generally parallel to said imprint plane, and said re-inking position being between said marking position and said storage position in the reciprocation path of said marking heads.

15. A marking machine as set forth in claim 14, said marking head and ink pad motors being fluid powered, and said control system being fluid operable.

* * * * *